US008540138B1

(12) United States Patent
Christensen et al.

(10) Patent No.: US 8,540,138 B1
(45) Date of Patent: Sep. 24, 2013

(54) STAIR STEP PORTFOLIO FILE

(75) Inventors: Duane Christensen, Hastings, MN (US); Tim Blegen, Spring Valley, WI (US); Dennis Bowen, Ellsworth, WI (US); Harold Peter Lindelof, Eden Prairie, MN (US)

(73) Assignee: Smead Manufacturing Company, Hastings, MN (US)

( * ) Notice: Subject to any disclaimer, the term of this patent is extended or adjusted under 35 U.S.C. 154(b) by 309 days.

(21) Appl. No.: 12/916,733

(22) Filed: Nov. 1, 2010

Related U.S. Application Data

(60) Provisional application No. 61/262,913, filed on Nov. 19, 2009.

(51) Int. Cl.
*B65D 27/00* (2006.01)

(52) U.S. Cl.
USPC ..... 229/67.3; 229/67.1

(58) Field of Classification Search
USPC ..... 229/67.1–67.4, 72
See application file for complete search history.

(56) References Cited

U.S. PATENT DOCUMENTS 314,598 A * 3/1885 Meek ..... 229/72
1,634,450 A * 7/1927 Alvah ..... 229/67.3
2,729,258 A * 1/1956 Pentland et al. ..... 206/553
3,113,573 A * 12/1963 Eli ..... 229/67.3
4,669,651 A * 6/1987 Shaw et al. ..... 229/67.3
4,932,683 A * 6/1990 Perazza ..... 283/74
8,425,387 B1 * 4/2013 Christensen et al. ..... 493/186

OTHER PUBLICATIONS

Globe-Weis 13 Pocket Stand & File Portfolio & Quickvue File, Item No. 17125.
Esselte Pendaflex On The Go Desktop File, Item No. 51068.
Globe-Weis Quick Vue Project File, Monthly Index, Item No. 20135.
Globe-Weis Quick Vue Project File, A-Z Index, Item No. 20134.
Globe-Weis Quick Vue Project File, Item No. 20131.

* cited by examiner

*Primary Examiner* — Jes F Pascua
(74) *Attorney, Agent, or Firm* — Altera Law Group, LLC

(57) ABSTRACT

A stair-step, expandable file folder is disclosed, in which each pocket in the folder has the same depth, rather than the back pockets being deeper than the front pockets. The folder includes a series of dividers that form the front and back sides of the pockets of the folder. The top edges of the dividers have increasing height, from the front to the back of the folder. The dividers are folded to form the bottoms of the pockets, with the folded portions also increasing in height from the front to the back of the folder. Each divider extends downward to form the back face of a pocket, is folded forward to form the bottom face of the pocket, and is folded downward to extend toward the bottom edge of the folder. The troughs in an expandable gusset support the sides of the dividers. Above the fold portion, the divider laterally extends into one trough. Below the fold portion, the divider laterally extends into the adjacent trough toward the front of the folder.

15 Claims, 13 Drawing Sheets

STAIR STEP PORTFOLIO FILE

CROSS-REFERENCE TO RELATED APPLICATION

This application claims the benefit of U.S. Provisional Application No. 61/262,913 filed 19 Nov. 2009, which hereby are incorporated herein by reference in its entirety.

BACKGROUND OF THE INVENTION

1. Field of the Invention

The present invention is directed to file folders, and more particularly to stair-step style expandable file folders.

2. Description of the Related Art

File folders are common in home and office settings.

A typical expandable file folder includes a series of rectangular dividers that are joined on three sides to respective pleats in an expandable gusset. The folder has pockets formed between each adjacent pair of dividers. Each pocket is accessible from the unbound edge of the dividers, which will be referred to in this document as the top edge of the file folder.

One common type of expandable file folder is referred to as a stair-step expandable folder. In a stair-step expandable folder, the dividers extend by different amounts along the top edge of the folder. The dividers at the back of the folder extend upward farther than those at the front of the folder, so that the top edges of all the dividers are viewable simultaneously. A user can select a desired pocket directly, rather than having to flip through all the dividers to find the correct pocket.

One potential drawback to typical stair-step expandable folders is that the pockets have different depths. Because the dividers at the rear of the folder extend farther upward than those at the front of the folder, the pockets at the rear of the folder are deeper than those at the front of the folder. As a result, documents stored in a rear pocket are more difficult to access than those stored in a front pocket. This difficulty in accessing the rear pockets is unacceptable.

Accordingly, there exists a need for a stair-step expandable file folder in which the stored documents are easily accessible for all pockets.

BRIEF SUMMARY OF THE INVENTION

An embodiment is a stair-step file folder having a plurality of top-accessible pockets, comprising: a plurality of dividers defining the pockets therebetween; a web formed to provide a bottom and two sidewalls of the folder; a plurality of dividers of uniform height between a front face of the folder and a back face of the folder, said dividers being affixed to said web at the sidewalls thereof; each divider having an upper generally planar portion lying with in a first plane, a fold portion, constituting a floor, that extends generally orthogonally from said plane and away from the upper planar portion and a lower generally planar portion extending generally orthogonally from said fold portion and residing in a second plane parallel to and offset from said first plane; the plurality of dividers being spaced apart generally equal to an offset created by the fold portion; the plurality of dividers being joined such that each floor is bounded by planar portions of successive dividers; the location of the fold portion on each divider being successively higher from front to back, so that the floor of each pocket is likewise successively higher; and each divider being formed of a continuous web material.

Another embodiment is a method for constructing a file folder having a plurality of adjacent pockets of equal pocket depths in an expandable stair-step file folder, comprising:

providing a plurality of dividers defining pockets therebetween, the dividers increasing in height from the front to the back of the folder; and folding each divider at a fold point along its surface to form a bottom for each respective pocket, the fold point increasing in height from the front to the back of the folder.

A further embodiment is a rectangular file folder, comprising: an expandable gusset forming a bottom edge and two side edges of the folder; and a plurality of dividers extending laterally across the folder and oriented parallel to a front face and a back face of the folder. Each pair of adjacent dividers defines a pocket therebetween. Each divider joins the gusset at a respective fold in the gusset along the side edges of the folder. Along a top edge of the folder, each divider in the plurality extends farther upward than all other dividers between said divider and the front face of the folder. Each divider includes at least one laterally-oriented fold that forms a bottom edge of a respective pocket. The respective folds in the dividers are all at different distances from the bottom edge of the folder. The respective folds in the dividers are all at equal distances from top edges of the respective dividers, so that the depths of the respective pockets are generally the same.

An additional embodiment is an expandable stair-step file folder, comprising: an expandable gusset forming a bottom edge and two side edges of the folder, the gusset including repeating folds that form a series of regularly-spaced troughs parallel to a front face and a back face of the folder, the troughs extending continuously along the bottom edge and the two side edges of the folder; and a plurality of dividers within the troughs, each divider including: a top portion parallel to the front face of the folder, the top portion extending laterally between the two side edges of the folder and extending vertically down to a top fold line, the top fold line being parallel to the bottom edge of the folder; an intermediate portion extending toward the front face of the folder from the top fold line to a bottom fold line, the intermediate portion extending generally horizontally between a pair of adjacent troughs, the bottom fold line being parallel to the bottom edge of the folder; and a bottom portion parallel to the front face of the folder, the bottom portion extending vertically from the bottom fold line and extending laterally between the two side edges of the folder. The top and bottom portions each extend into adjacent troughs. The intermediate portions of the dividers are all at different heights.

A further additional embodiment is a method of producing an expandable stair-step file folder, comprising: providing an expandable gusset along a bottom edge and two side edges of the folder, the gusset including repeating folds that form a series of regularly-spaced troughs parallel to a front face and a back face of the folder, the troughs extending along the bottom edge and the two side edges of the folder; and for each trough: providing a generally rectangular sheet having top, bottom and side edges; folding the sheet a first time to form a first fold line parallel to the top and bottom edges of the sheet; folding the sheet a second time to form a second fold line adjacent to and parallel to the first fold line and disposed between the first fold line and the bottom edge of the sheet; reducing the width of the sheet between the first and second fold lines; inserting into the trough a portion of the sheet from the bottom edge of the sheet to the second fold line; extending generally horizontally a portion of the sheet between the first and second fold lines; and inserting into an adjacent trough a portion of the sheet from the first fold line to the top edge of the sheet.

DETAILED DESCRIPTION OF THE INVENTION

A stair-step, expandable file folder is disclosed, in which each pocket in the folder has the predeterminable depth, preferably the same depth, rather than the back pockets being automatically deeper than the front pockets. The folder includes a series of dividers that form the front and back sides of the pockets of the folder. The dividers have predetermined height, usually increasing height, from the front to the back of the folder. It is however possible to utilize this invention to have pockets of different depth depending upon need. For example, it is possible that some pockets could be suitable for A-4 or Letter size depth in landscape (horizontal) orientation while others could be in letter (vertical) orientation. Likewise, other paper formats could be accommodated by setting different predetermined depths for different pockets.

The dividers are folded to form the bottoms of the pockets, with the folded portions also increasing in height from the front to the back of the folder. Each divider extends downward to form the back face of a pocket, is folded forward to form the bottom face of the pocket, and is folded downward to extend to the bottom edge of the folder. The troughs in an expandable gusset support the bottom and the sides of the dividers. Above the fold portion, the divider laterally extends into one trough. Below the fold portion, the divider laterally extends into the adjacent trough toward the front of the folder. In the preferred embodiment and to facilitate efficient manufacture and conservation of materials, the dividers are unitary, i.e. made of a single sheet or continuous web without joints, but merely with folds.

The preceding paragraph is merely a summary, and should not be construed as limiting in any way. A more detailed description follows.

Figure 1A:
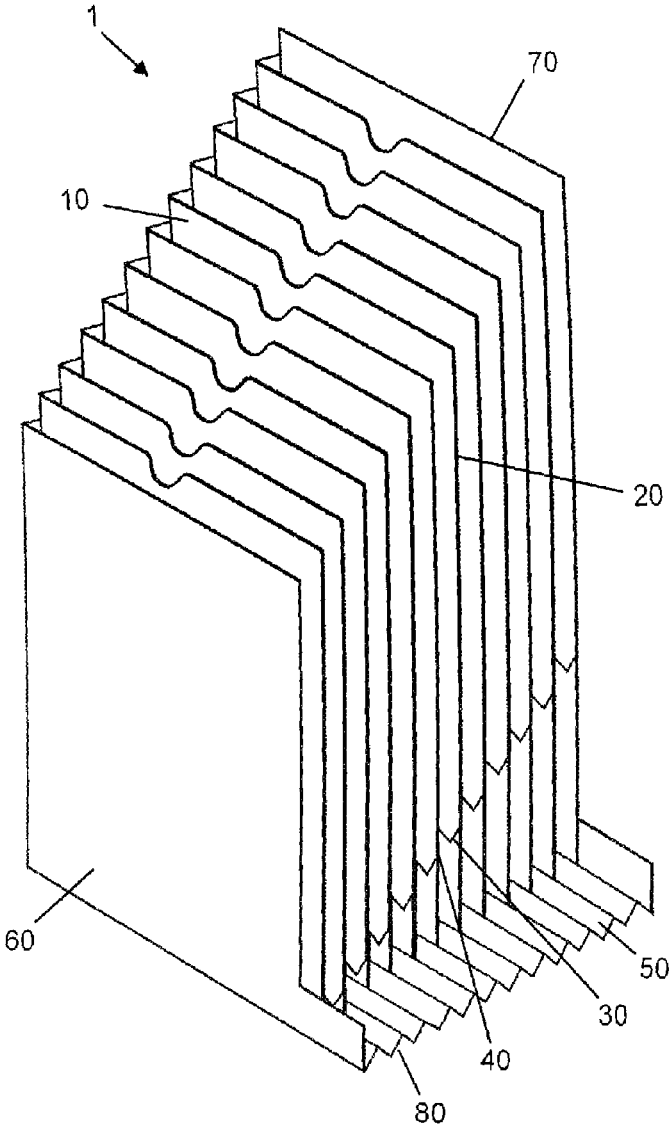
FIG. 1A is a cutaway drawing of the interior of an expandable stair-step folder.

FIG. 1A is a cutaway drawing of the interior of an expandable stair-step folder 1. The folder 1 has a series of laterally-extending pockets that are generally parallel to the front face 60 and the back face 70 of the folder 1. Documents may be inserted and removed from the top edges of the pockets. The pockets themselves are formed by a series of dividers 10. The dividers are supported on their side by an expandable gusset 50 that surrounds them on the bottom 80 and left and right sides of the folder 1. The gussets can be a web material which provides lightness and airflow, or solid.

In contrast with many known expandable folders, in which the pocket depth increases from the front to the back of the folder, the folder 1 has a uniform pocket depth from the front 60 to the back 70 of the folder 1. Rather than using the expandable gusset 50 at the bottom 80 of the folder to form the bottom of the pockets, the dividers 10 themselves are folded, with the folded portion 30 of the dividers 10 forming the bottom of the pockets. The folded portions 30 increase in height from the front 60 to the back 70 of the folder 1, maintaining a generally uniform distance from the top edges of the dividers, so that the pocket depth is generally the same for all pockets.

The front 60 and/or rear 70 faces of the folder may be optionally constructed differently than the dividers 10, so that the front and/or rear pockets in the folder 1 may be different in construction than the interior pockets.

Figure 1B:
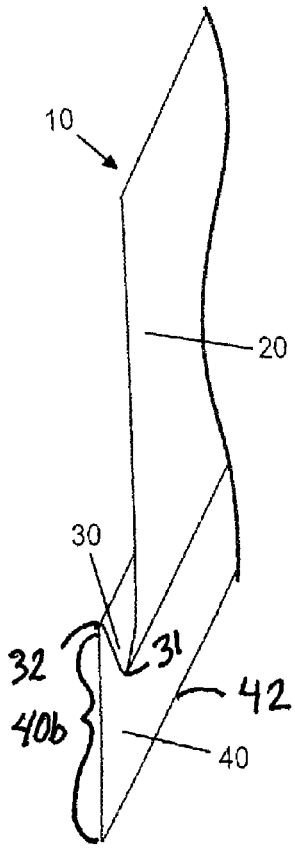
FIG. 1B is a cutaway drawing of one divider, viewed from the right/rear sides.

FIG. 1B is a cutaway drawing of one divider 10 from the folder 1, viewed from the right/rear sides. The divider 10 includes a top portion 20 that may extend laterally (horizontally) across the entire folder, and may extend vertically from a top edge down to a fold portion 30. The top portions 20 of all the dividers 10 form the front and back sides of the pockets. The fold portions 30 of all the dividers 10 form the bottoms of the pockets. The divider 10 may be further folded to have a bottom portion 40, adjacent to the fold portion 30 on the side opposite the top portion 20. The bottom portion 40 may optionally extend vertically from the fold portion 30 to a trough in the expandable gusset 50. The bottom portion may also optionally extend laterally across the entire folder 1, although it may alternatively be narrower than the troughs in the gusset 50. In this way a zig-zag fold consisting of portions 20, 30 and 40 are formed. The location of folds 31 and 32 determine the floor/bottom of the pocket. Fold 31 actually sets the "floor" and the length of material between 31-32 sets the width of the pocket. The length from 32 to the bottom edge 41 of the divider 10 sets the height of the floor from the true bottom of the folder.

In some cases, the top portions 20 of all the dividers are generally the same height, the fold portions 30 are all generally the same size, the bottom portions 40 are all generally the same width and increase in height from the front 60 to the back 70 of the folder 1.

Figure 2:
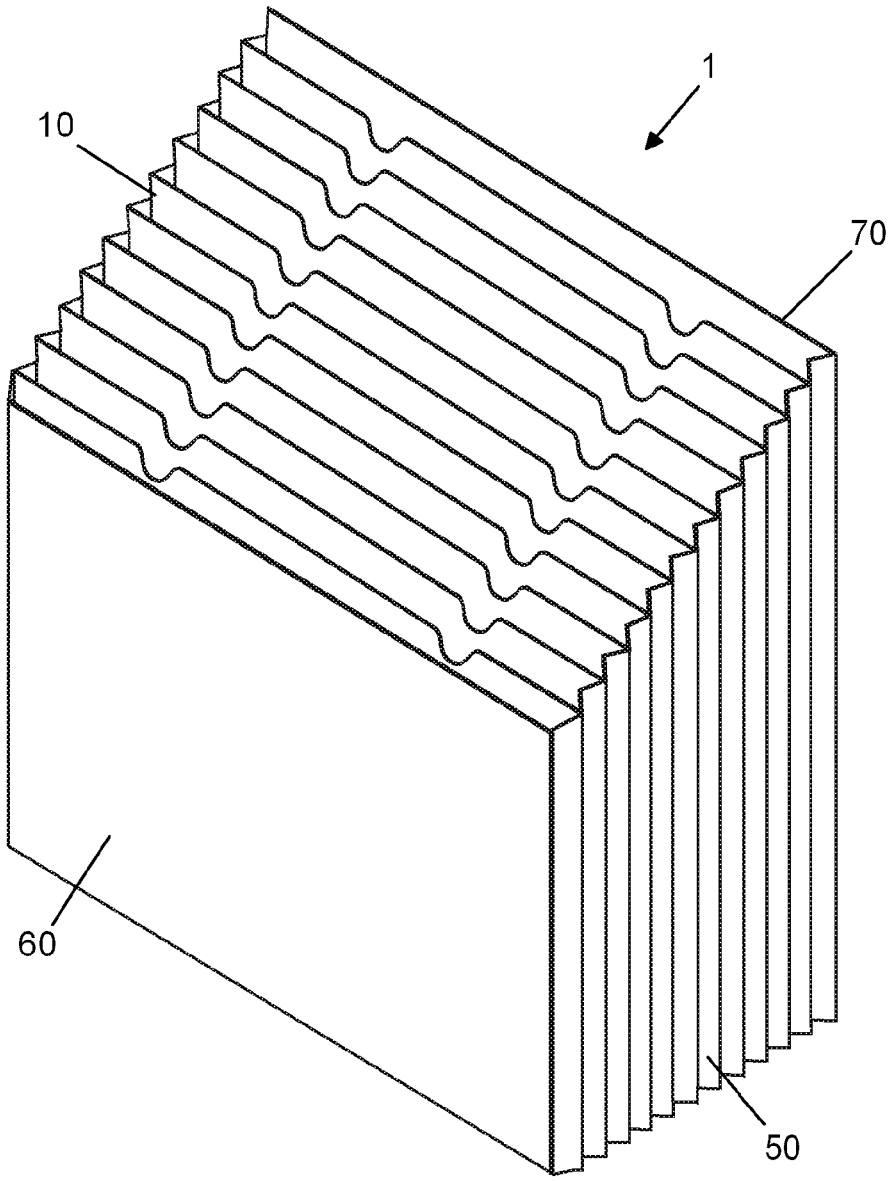
FIG. 2 is a plan drawing of an assembled stair-step folder.

FIG. 2 is a plan drawing of an assembled stair-step folder 1. When assembled, the fold portions 30 are blocked from view by the gusset 50, except from directly above the folder 1.

Figure 3A:
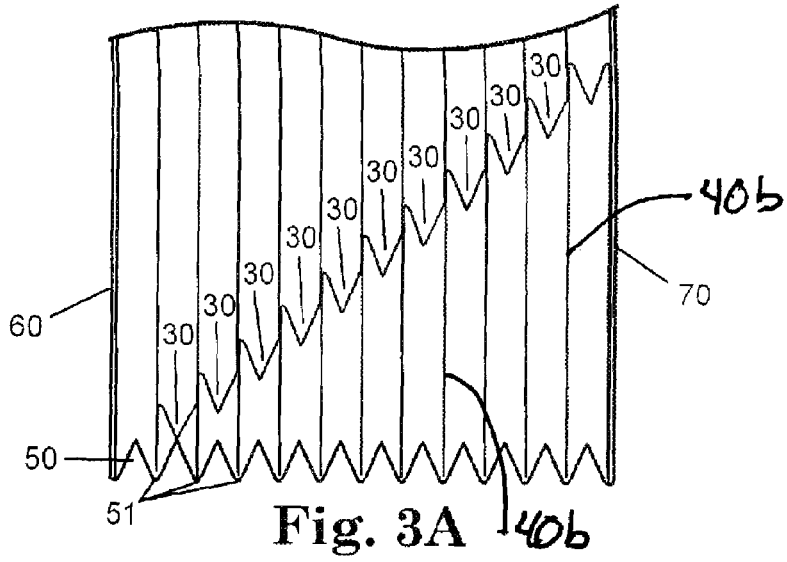
FIG. 3A is a close-up view of the folded portions and the expandable gusset at the bottom of the folder.

FIG. 3A is a close-up view of the folded portions 30 and the expandable gusset 50 at the bottom of the folder. The folded portions 30 increase in height from the front 60 to the back 70 of the folder, so that the pocket depth remains roughly constant for all the interior pockets in the folder. Notice that height 40*b* is increasing, but the depth of each pocket is uniform. As mentioned above, height 40*b* can vary according to user's needs so that some pockets can be deeper for shallower as desired.

It is also possible that fold 31 (FIG. 1B) could be perforated or have any number of other "break away" (i.e. be knocked out along its entire length) connections so that the bottom would become floor 51 (FIG. 3A). This would allow a user to selectively create a special deeper pocket "on the fly".

Figure 3B:
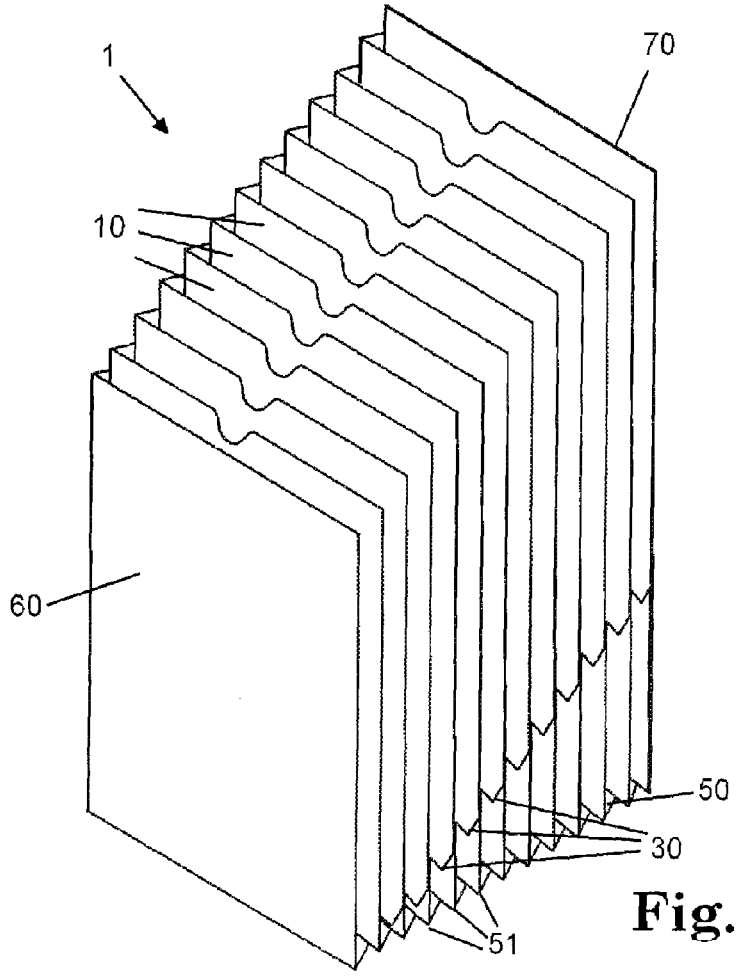
FIG. 3B is a full-width view of the interior of the folder, which has the left and right sides of the folder removed to expose the fold portions and troughs in the gusset.

FIG. 3B is a full-width view of the interior of the folder 1, which has the left and right sides of the folder removed to expose the fold portions 30 and troughs 51 in the gusset 50.

FIGS. 1A, 3A and 3B show how the dividers 10 fit into the gusset 50. Note the shape of each folded divider 10 from FIG. 1A. Note that the top portion 20 of each divider 10 extends laterally (left and right) into one particular groove or trough 51 in the gusset 50. From the top portion 20, the folded portion 30 extends toward the front 60 of the folder by exactly one trough 51. From the folded portion 30, the bottom portion 40 extends downward toward the bottom of the folder, and extends laterally into a trough 51 adjacent to the particular trough 51 noted above. In other words, the trough 51 that supports the bottom portion 40 of the divider 10 is different from the trough that supports the top portion 20, with the two troughs being directly adjacent to each other. Alternatively, the fold portion may extend forward by more than one trough, such as two troughs, three troughs, four troughs, and so forth.

Figure 4:
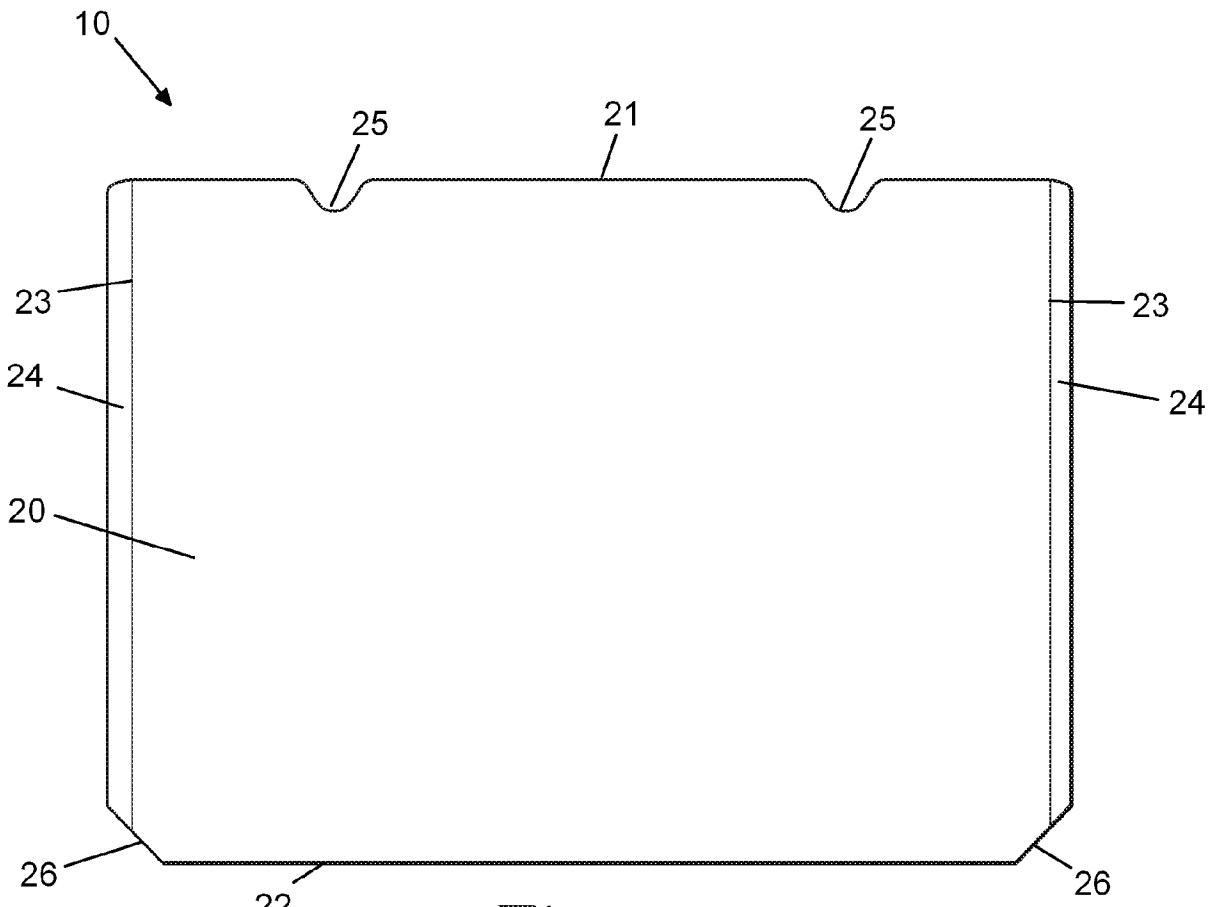
FIG. 4 is a front-view drawing of an exemplary top portion of a divider.

FIG. 4 is a front-view drawing of an exemplary top portion 20 of a divider 10.

The top portion 20 extends vertically from a top edge 21 down to a top fold 22. Below the top fold 22 is the folded portion, which is not shown in FIG. 4. The top edge may have one or more indentations 25 that can improve gripping of the particular divider for the user. In some cases, as is shown in FIGS. 1A, 2 and 3B, the indentations 25 are in the same locations for all the dividers. In other cases, the indentations 25 may be staggered or may vary laterally in location.

The top edge 21 of the divider may optionally include a label portion, on which the user may write or affix particular indicia for identifying the contents of the corresponding folder. Because of the stair-step effect of the folder 1, all or some of the label portions may be simultaneously viewed from the front 60 of the folder 1.

The lateral sides of the top portion 20 may have their bottom corners 26 clipped, so that the folded portion 30 (not shown) is laterally clear from the gusset 50. In general, it is desirable that the folded portions 30 be narrower than the interior width of the gusset 50.

The lateral sides of the top portion 20 may have optional folded wings 24. These wings 24 may be folded along fold lines 23, then inserted into corresponding troughs in the gusset. The wings 24 naturally unfold a bit when released, thereby forming a friction fit with the gusset 50 that helps keep the divider 10 in place. The wings 24 also strengthen the lateral sides of the dividers. Optionally, the dividers may be further glued in place with a suitable adhesive. In some cases, the adhesive may be applied on the wings 24.

Figure 5:
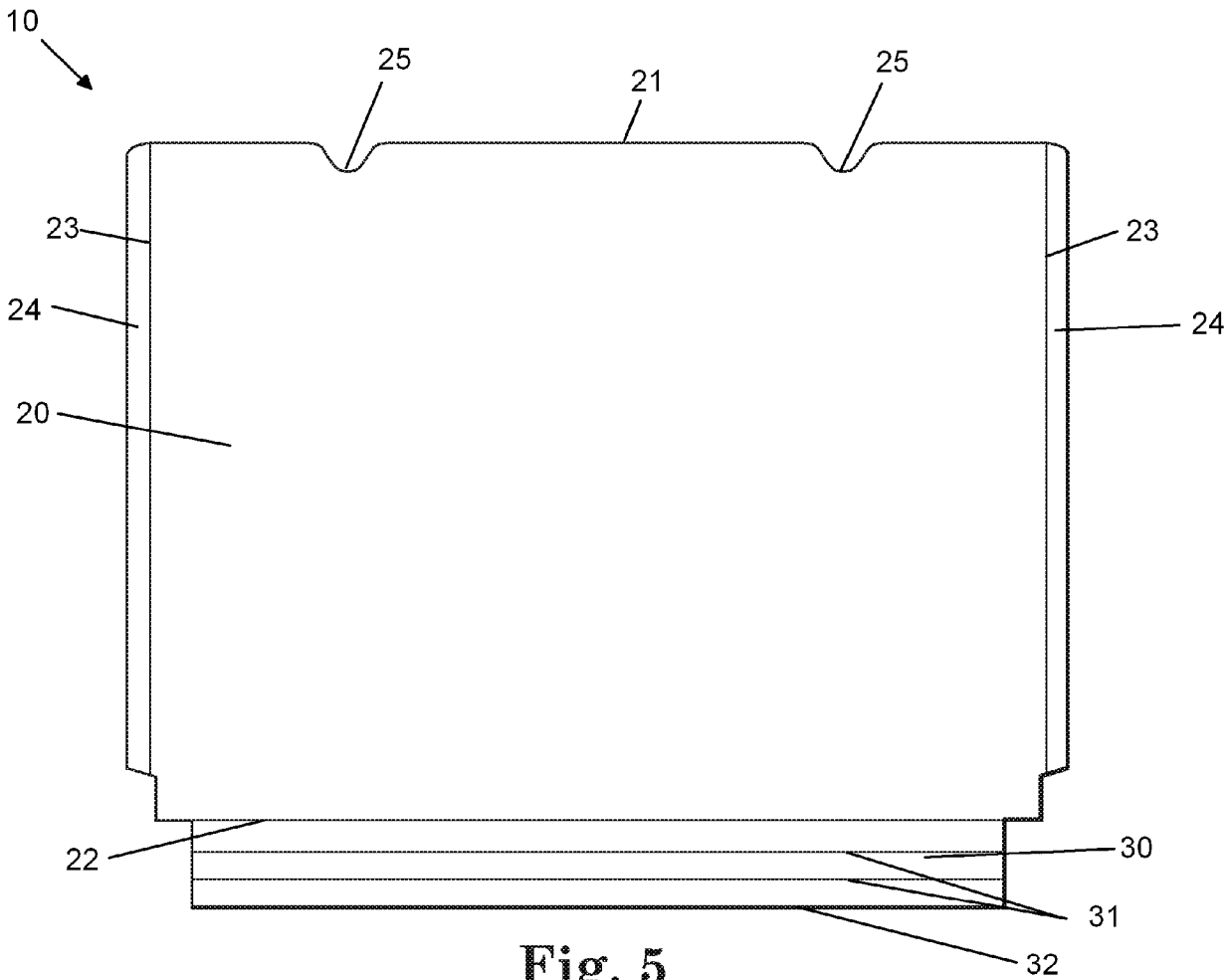
FIG. 5 is a front-view drawing of exemplary top and folded portions of a divider.

FIG. 5 is a front-view drawing of exemplary top 20 and folded 30 portions of a divider 10.

From the top fold line 22, the folded portion extends to the bottom fold line 32. In practice, the folded portion may extend away from the plane of the top portion 20; FIG. 5 shows the top and folded portions in an unfolded state, pressed flat. The folded portion 30 may include one or more additional folds 31. In some cases, the number of additional folds 31 may correspond to the number of pleats, folds, creases, troughs, or grooves in the expandable gusset, so that the folded portion may expand or contract along with the gusset. For instance, if the top and bottom portions of the divider are to fit into directly adjacent troughs in the gusset, there may be a single additional fold 31 in the folded portion 30. Other configurations are possible as well.

It should be noted that with one or more additional fold lines 31, the actual folded portion 30 may be essentially horizontal when the gusset is completely expanded, but may be compressed to lie essentially vertical when the gusset is completely compressed. For the purposes of this document, such a folded portion 30 is said to "horizontally extend" from one trough to another trough in the folder, even though the actual folded portion may truly extend with a downward component (pitch) from the top fold line 22 to the additional fold line 31, then with an upward component from the additional fold line 31 to the bottom fold line 32. In other words, the horizontal extension may apply from the top fold line 22 to the bottom fold line 32, which may be truly horizontally (orthogonally) separated, even though the folded portion 30 that connects them may dip downward in the middle. For purposes of this patent the term "generally orthogonal" is meant to mean "extending away" from the planar portion of the divider even if not truly orthogonal and regardless of the pitch. The figures show portion 30 has a pitch off the right angle and we intend to include this in our meaning of generally orthogonal. Notice though that this dip or pitch provides benefit to the user by helping to separate sheet of papers in a stair-step manner within the pocket. It is therefore possible to have a "double step" configuration where there are two folds 31-32 in succession (not shown) within each pocket to provide a shelf or step within the pocket for segregating papers.

Note that the preferred lateral width of the folded portion 30 is less than that of the top portion 20. While it is desirable that the top portion 20 engage a particular trough in the gusset, it is also desirable that the folded portion 30 be clear of the gusset.

Figure 6:
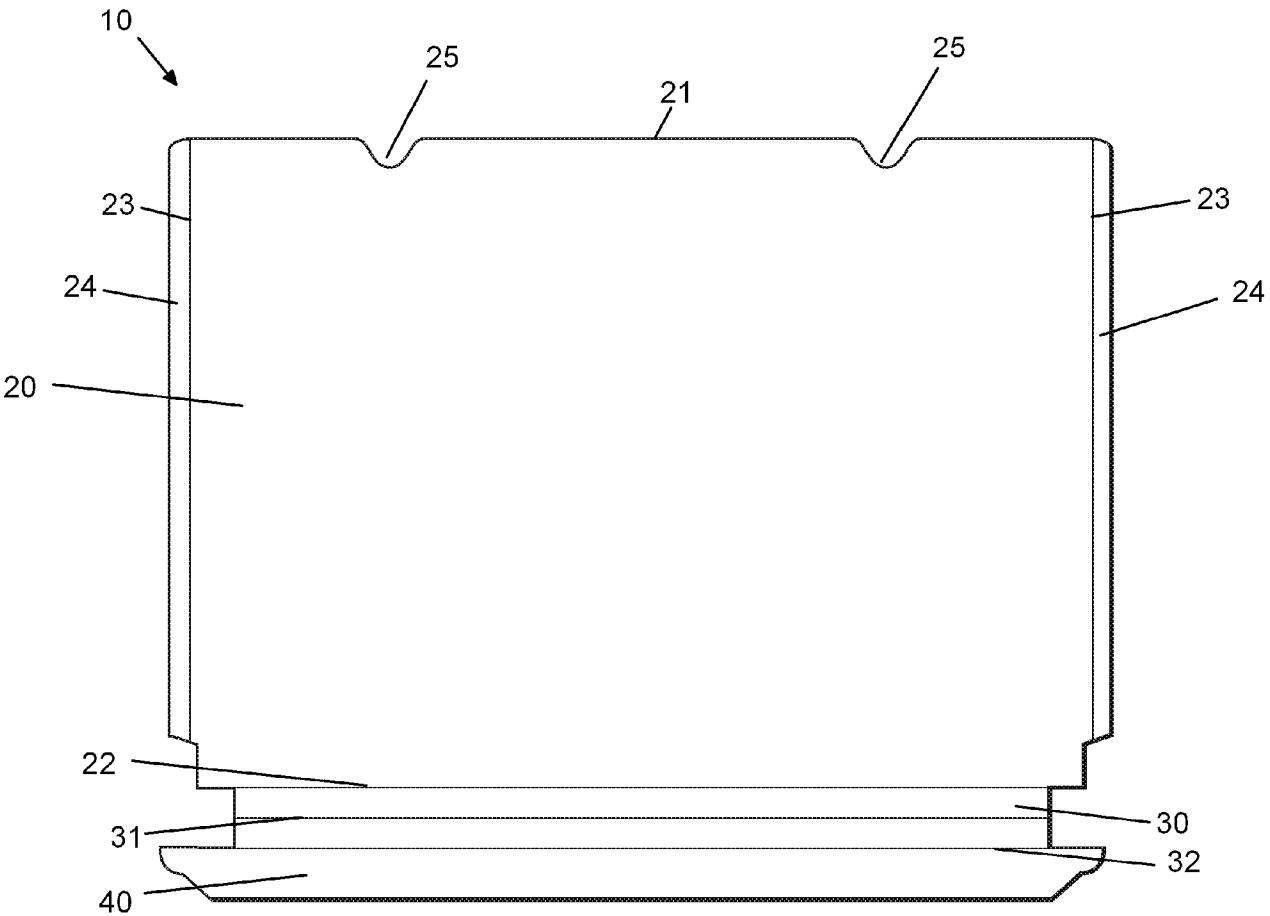
FIG. 6 is a front-view drawing of exemplary top, folded and bottom portions of a divider.

FIG. 6 is a front-view drawing of exemplary top 20, folded 30 and bottom 40 portions of a divider 10. Here, there is only one additional fold line 31 in the folded portion 30.

From the bottom fold line 32, the bottom portion 40 may be folded either upward, toward the top of the folder, or downward, toward the bottom of the folder. In either case, the bottom portion 40 may contact the adjacent divider, toward the front of the folder. In the region of contact, two dividers may both share a single trough in the gusset. Alternatively, the folded portion 30 may extend from the top portion 20 toward the back of the folder, and the bottom portion may not necessarily contact the adjacent divider.

In FIG. 6, the exemplary bottom portion 40 may not reach the bottom of the folder. Alternatively, the bottom portion 40 does reach the bottom of the folder, and may extend into a trough in the gusset for support.

Figure 7:
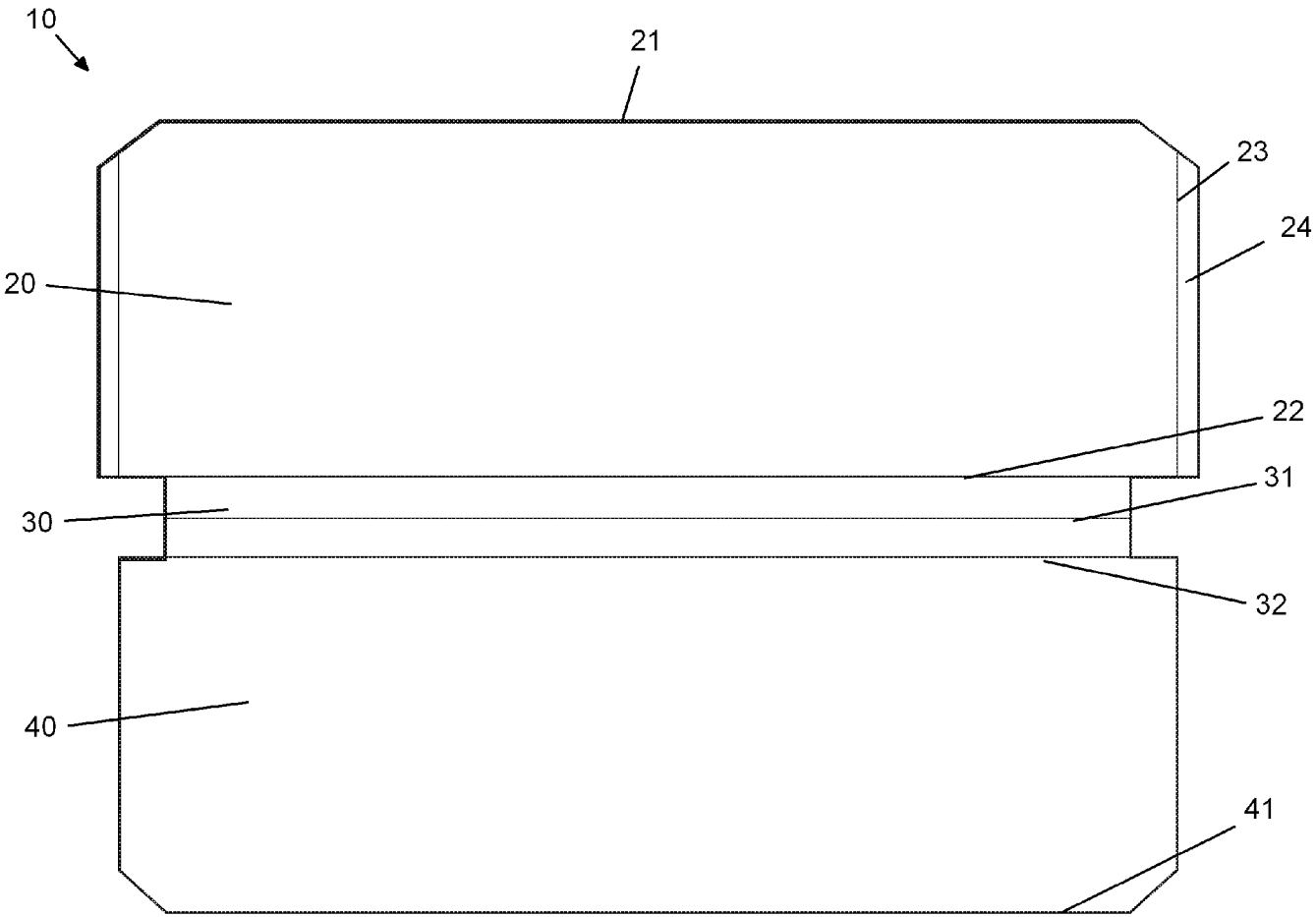
FIG. 7 is a front-view drawing of exemplary top, folded and bottom portions of a divider, in which the bottom portion extends down to the bottom of the folder.

FIG. 7 is a front-view drawing of exemplary top 20, folded 30 and bottom 40 portions of a divider 10, in which the bottom portion 40 extends down to the bottom of the folder. As with FIGS. 5 and 6, FIG. 7 shows the divider in unfolded form, pressed flat.

The bottom portion 40 extends vertically downward from the bottom fold line 32 to its bottom edge 41. In some cases, the bottom edge 41 fits into a trough in the gusset for support. In many cases, the bottom edge 41 fits into the same trough as the lateral sides of the bottom portion 40, so that the bottom portion is supported on three sides by the same trough.

The bottom edge 41 may optionally have its corners removed, in order to reduce interference with the bottom left and bottom right corners of the gusset.

Figure 8:
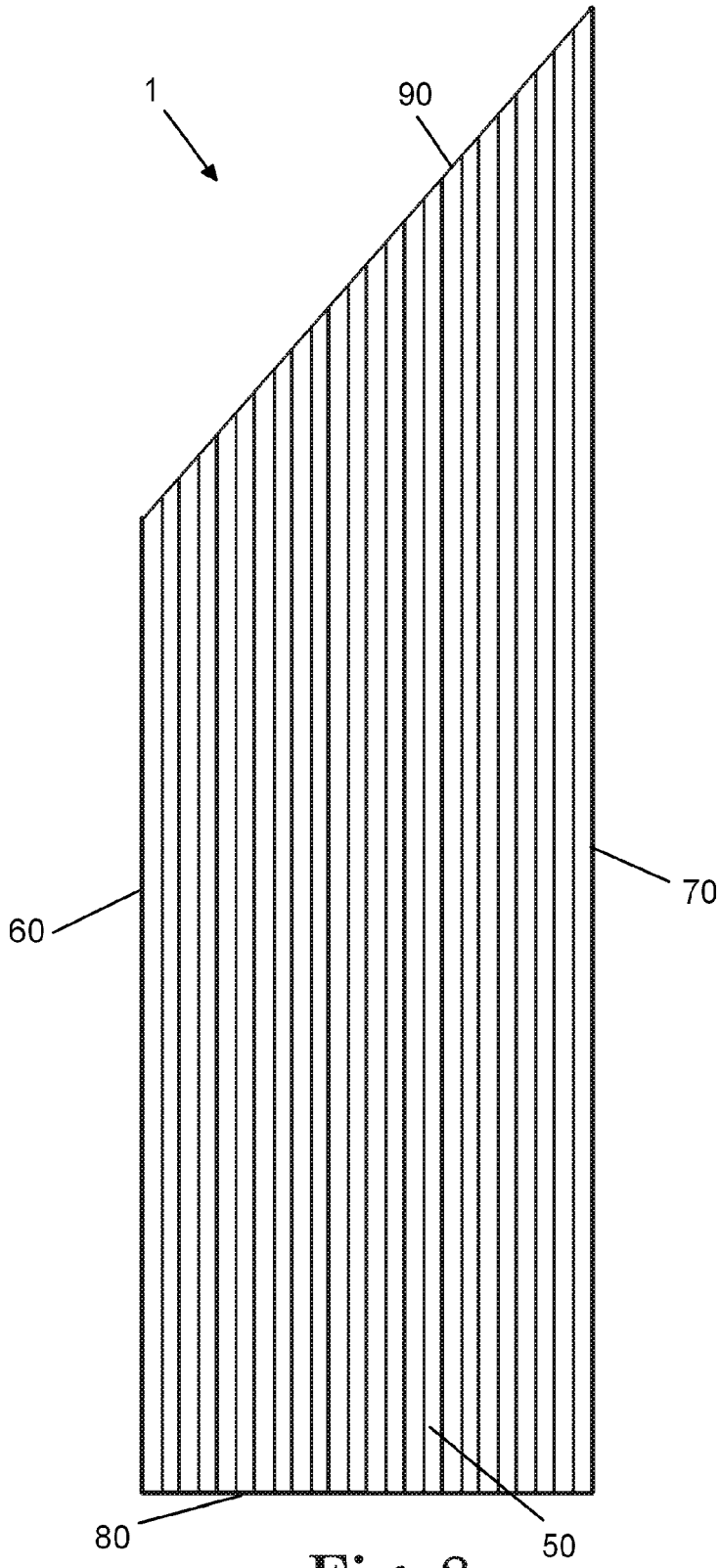
FIG. 8 is a right-side-view drawing of the assembled file folder.

FIG. 8 is a right-side-view drawing of the assembled file folder 1. The internal structure is essentially completely hidden by the gusset 50. We see the edges of the front face 60, the back face 70, the bottom 80 of the gusset, and the top 90 of the folder 1.

Note that the bottom 80 of the gusset is drawn in FIG. 8 as a plane, but may in practice include the pleats, folds, or ridges from the expandable gusset 50. Note also that the top 90 of the folder is also drawn in FIG. 8 as a plane, although away from the gusset in the interior of the folder, the folder may not have a single top surface. For instance, the folder may have pockets that open to the top, so that there is no single top surface, only the top edges of the dividers.

Figure 9:
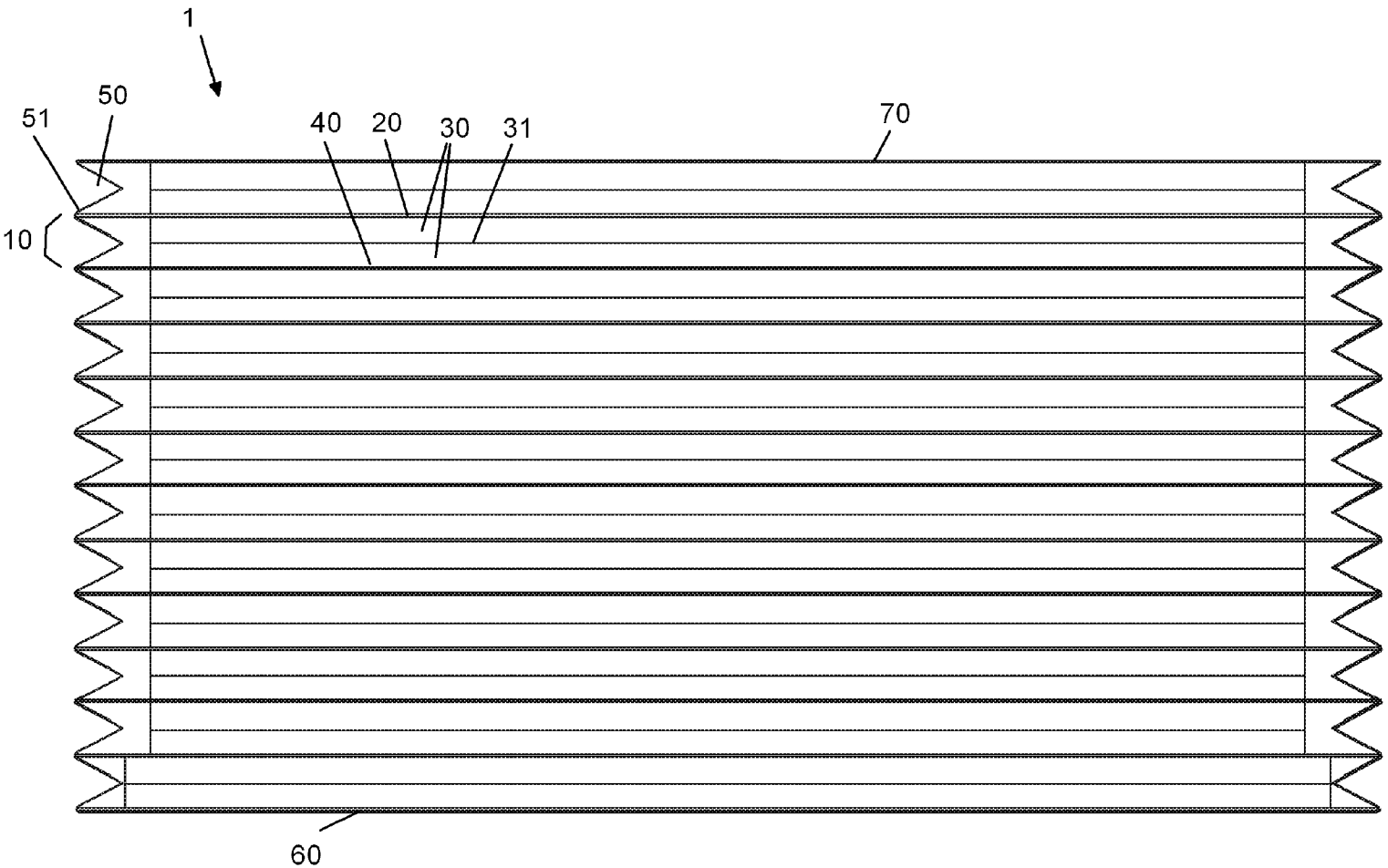
FIG. 9 is a top-view drawing of the assembled file folder.

FIG. 9 is a top-view drawing of the assembled file folder 1. The front face 60 is at the bottom of the drawing, and the back face 70 is at the top of the drawing.

FIG. 9 shows series of pockets, as viewed from above. FIG. 9 includes element numbers for one particular divider 10, although it will be understood that other dividers are similar in function and construction. The top portion 20 of the divider 10 extends laterally into the trough 51 in the guest 50. The top portion 20 extends from the top of the folder (closest to the viewer) downward (into the page) to the folded portion 30. The folded portion 30 extends generally toward the front 60 of the folder (downward in the drawing), with a single additional fold line 31. It is understood that the folded portion 30 may be expanded and contracted as needed, along with the gusset. The bottom portion 40 extends from the folded portion 30 toward the bottom of the folder (into the page).

Note that the frontmost pocket in the folder 1, adjacent to the front face 60 of the folder 1, may have a different structure than the other pockets. In this case, the pocket is formed from the front face 60 of the folder on its front, the expandable gusset on its lateral sides and bottom, and an unfolded divider on its rear.

Figure 10:
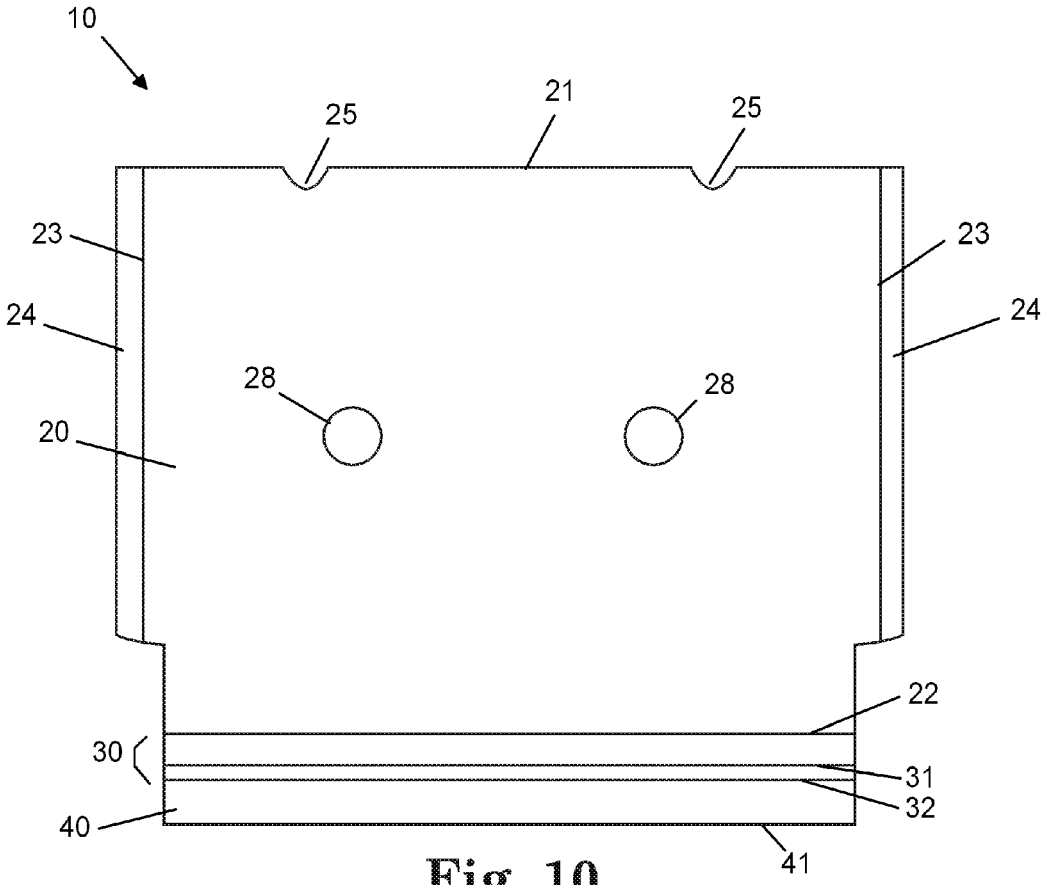
FIG. 10 is a front-view drawing of exemplary top, folded and bottom portions of a divider, in which the top portion includes one or more additional holes in its interior.

FIG. 10 is a front-view drawing of exemplary top 20, folded 30 and bottom 40 portions of a divider 10, in which the top portion 20 includes one or more additional holes 28 in its interior. Such optional holes 28 may aid the user in gripping a particular divider, much like the indentations 25.

Figure 11:
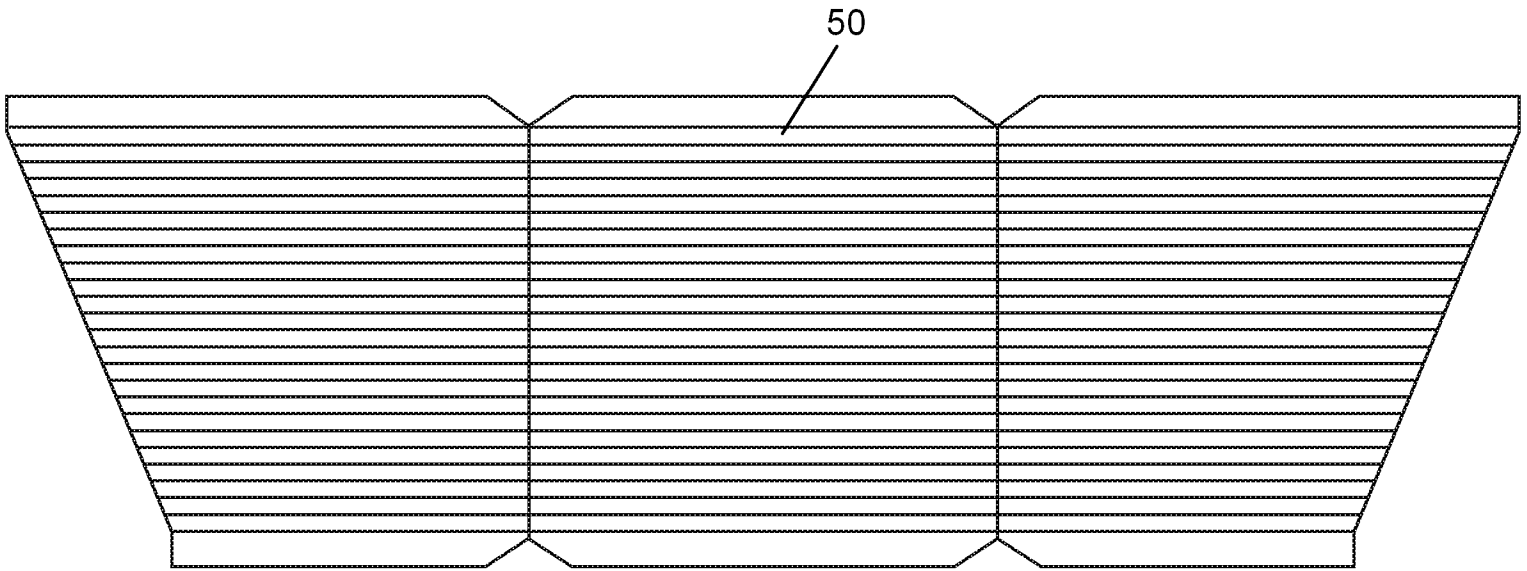
FIG. 11 is a top-view drawing of an unfolded gusset.

FIG. 11 is a top-view drawing of an unfolded gusset 50. In FIG. 11, the front of the folder is at the bottom of the drawing, and the back of the folder is at the top of the drawing.

Note that in most cases, the gusset 50 includes pleats, folds or troughs that extend over the entire gusset, namely from the top left of the folder, to the bottom left, to the bottom right, to the top right of the folder, when assembled. It may also be a web or net material, elastic or inelastic.

The gusset 50 may be made from a single sheet, with appropriate accordion folds for expansion. There may be notches in the gusset at the bottom left front, bottom left back, bottom right front, and bottom right back corners of the folder, when assembled. These notches reduce or eliminate interference when the gusset is folded.

Note that in FIGS. 1A and 1B, the dividers extend from the slanted topmost edge of the folder, down to the bottom of the respective pockets, forward to the adjacent divider, and down to the flat bottom edge of the folder. An alternative to this geometry is shown in FIGS. 12 and 13.

Figure 12A:
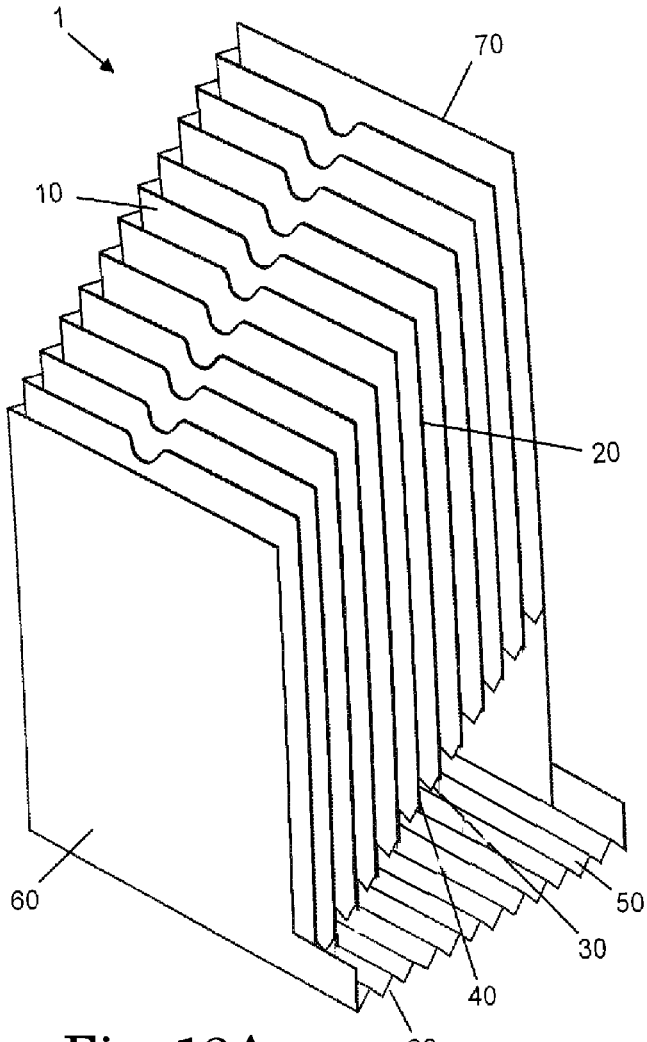
FIG. 12A is a cutaway drawing of the interior of an expandable stair-step folder.
Figure 12B:
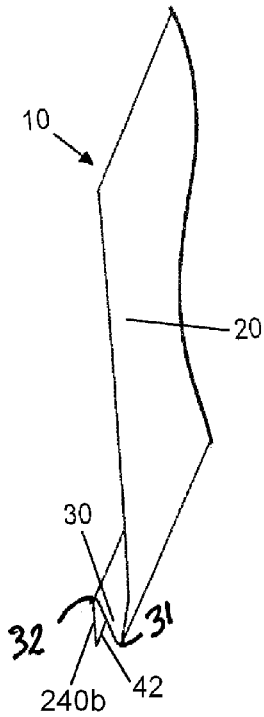
FIG. 12B is a cutaway drawing of one divider, viewed from the right/rear sides.
Figure 13A:
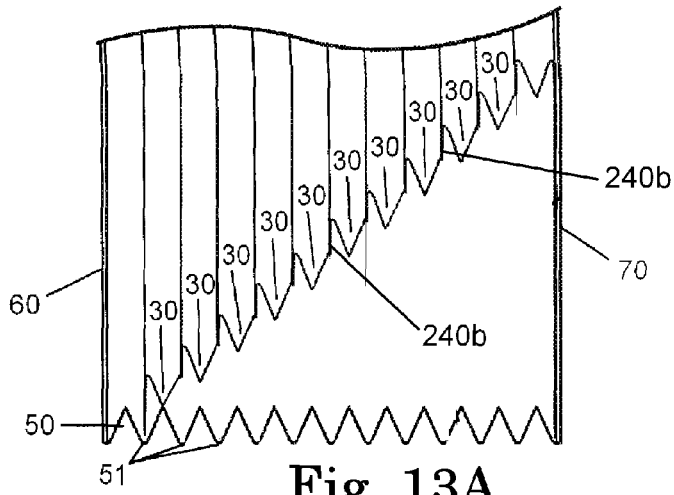
FIG. 13A is a close-up view of the folded portions and the expandable gusset at the bottom of the folder.
Figure 13B:
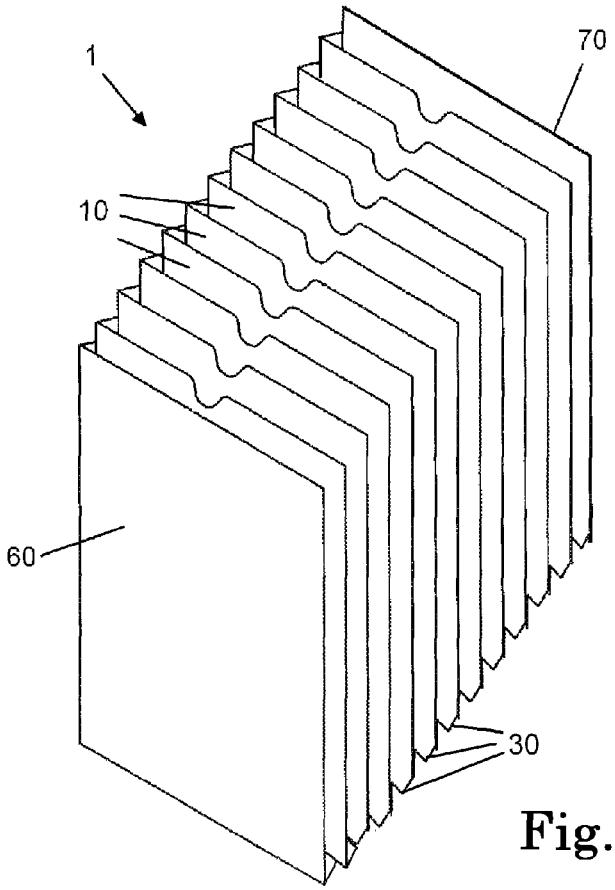
FIG. 13B is a full-width view of the interior of the folder, which has the left and right sides of the folder removed to expose the fold portions and troughs in the gusset.

FIG. 12A is a cutaway drawing of an alternative interior of an expandable stair-step folder. FIG. 12B is a cutaway drawing of one divider from the folder, viewed from the right/rear sides. Unlike the dividers in FIGS. 1A and 1B, the dividers in FIG. 12 extend only a small portion 240*b* downward from the adjacent divider, rather than extend downward fully to the bottom edge of the folder. This small portion 240*b* of downward extension may be used for adhering the divider to the adjacent divider, and may be used for the application of glue or other suitable adhesive.

There may be advantages to having the dividers as shown in FIG. 12. For instance, the internal dividers may all have a uniform size, rather than increasing in size from the front of the folder to the back of the folder. Note that the dividers at the front and rear faces of the folder may still be sized differently than the internal dividers. As another example, the internal dividers may all be folded in the same location on the divider, rather than at a different location for each divider. In some cases, this uniformity in sizing and folding may be advantageous for manufacturing the folder.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. A stair-step file folder having a plurality of top-accessible pockets, comprising:

a plurality of dividers defining the pockets therebetween;

a web formed to provide a bottom and two sidewalls of the folder;

a plurality of dividers of uniform height between and having a front back face, said dividers being affixed to said web at the sidewalls thereof;

each divider having an upper generally planar portion lying with in a first plane, a fold portion, constituting a floor, that extends generally orthogonally from said plane and away from the upper planar portion and a lower generally planar portion extending generally orthogonally from said fold portion and residing in a second plane parallel to and offset from said first plane;

the plurality of dividers being spaced apart generally equal to an offset created by the fold portion;

the plurality of dividers being joined such that each floor is bounded by planar portions of successive dividers;

the location of the fold portion on each divider being successively higher from front to back, so that the floor of each pocket is likewise successively higher; and each divider being formed of a continuous web and wherein each divider has an upper portion above the fold portion that defines a back edge of a respective pocket; and wherein each divider has a lower portion below the fold portion that contacts an adjacent divider and extends downward.

2. The folder of claim 1, wherein the fold portion includes a top fold directly adjacent to the top portion, a bottom fold directly adjacent to the bottom portion, and a central fold halfway between the top and bottom folds.

3. The folder of claim 2, wherein the web further comprises a gusset supporting the bottom and sides of the dividers, the gusset and the fold portions of the dividers being expandable.

4. The folder of claim 1, wherein said generally orthogonal fold portion is angled downwardly toward the front of the folder.

5. A rectangular file folder, comprising:

an expandable gusset forming a bottom edge and two side edges of the folder, a front face and a back face of the folder generally spaced part from each other; and a plurality of dividers extending laterally across the folder and oriented parallel to said front face and back face of the folder;

each pair of adjacent dividers defines a pocket therebetween;

each divider joins the gusset at a respective fold in the gusset along the side edges of the folder;

along a top edge of the folder, each divider in the plurality extends progressively higher than all other dividers between said divider and the front face of the folder;

each divider includes a fold portion including at least one laterally-oriented fold that forms a bottom edge of a respective pocket and a further fold, thereby creating a floor portion between said folds and a small portion extending from said floor portion, and wherein said portion is affixed to a divider immediately adjacent thereby joining successive dividers;

wherein the respective folds are at the bottom of the divider and where the length of each divider is substantially the same regardless of its position in the file folder but the location of the respective folds relative to the bottom of the folder is progressively higher from front to back; and so that the depths of the respective pockets are generally the same, said folder, further including a supporting back wall extending from a bottom of the folder and upwardly therefrom, and wherein rearmost divider is affixed thereto thereby defining a generally space between the bottom of the folder and the bottoms of the dividers.

6. The folder of claim 5, wherein the fold portion includes at least two folds;

wherein the at least two folds include at least one convex fold and at least one concave fold; and wherein the bottom portion extends downward from the fold portion toward the bottom edge of the folder.

7. The folder of claim 5, further including a supporting portion extending from the bottom of the folder and upwardly therefrom and wherein at least some of said dividers are suspended above said floor portion at successively higher elevations thereabove by said small portion.

8. The folder of claim 5, wherein the top edge of each divider includes a label portion; and wherein the label portions of all the dividers are simultaneously viewable.

9. An expandable stair-step file folder, comprising:

an expandable gusset forming a bottom edge and two side edges of the folder, the gusset including repeating folds that form a series of regularly-spaced troughs parallel to a front face and a back face of the folder, the troughs extending continuously along the bottom edge and the two side edges of the folder; and a plurality of dividers within the troughs, formed from a continuous web, each divider including:

a top portion parallel to the front face of the folder, the top portion extending laterally between the two side edges of the folder and extending vertically down to a top fold line, the top fold line being parallel to the bottom edge of the folder;

an intermediate portion extending toward the front face of the folder from the top fold line to a bottom fold line, the intermediate portion extending generally laterally between a pair of adjacent troughs, the bottom fold line being parallel to the bottom edge of the folder; and a bottom portion parallel to the front face of the folder, the bottom portion extending vertically from the bottom fold line and extending laterally between the two side edges of the folder;

wherein the top and bottom portions each extend into adjacent troughs;

wherein the intermediate portions of the dividers are all at different heights.

10. The folder of claim 9, wherein the top portion of a particular divider extends into a first trough along the two side edges of the folder; and wherein the bottom portion of the particular divider extends into a second trough directly adjacent to the first trough along the two side edges of the folder.

11. The folder of claim 10, wherein the second trough is disposed between the first trough and the front face of the folder.

12. The folder of claim 9, wherein the bottom edge of the folder is perpendicular to the front face, the back face, the bottom edge and the side edges of the folder;

wherein the back face of the folder extends upward farther than the top face of the folder;

wherein a top edge of the folder comprises a plane connecting a top edge of the back face to a top edge of the front face; and wherein each divider in the plurality extends vertically from the intermediate portion to the top edge of the folder.

13. The folder of claim 12, wherein the top and bottom portions of all the dividers in the plurality are the same height;

whereby a plurality of pockets formed by adjacent pairs of dividers are all the same depth.

14. The folder of claim 9, wherein the intermediate portion of each divider in the plurality includes exactly one fold line halfway between the top fold line and the bottom fold line;

whereby the intermediate portion of each divider is expandable with the repeating folds of the gusset.

15. The folder of claim 9, wherein the intermediate portion of each divider is narrower than the top and bottom portions, and does not extend into the troughs.

* * * * *